US005557994A

United States Patent [19]

Nakayama

[11] Patent Number: 5,557,994

[45] Date of Patent: Sep. 24, 1996

[54] RATCHET HANDLE WITH TORQUE ADJUSTMENT

[76] Inventor: Tatsuo Nakayama, 16818 Dallas Pkwy., Dallas, Dallas County, Tex. 75248

[21] Appl. No.: 503,436

[22] Filed: Jul. 17, 1995

[51] Int. Cl.[6] ..... B25B 23/142

[52] U.S. Cl. ..... 81/478; 81/63; 73/862.23; 73/862.27

[58] Field of Search ..... 81/477–479, 483, 81/63; 73/862.22–862.24, 862.27, 862.31, 862.321, 862.325; 173/16

[56] References Cited

U.S. PATENT DOCUMENTS 5,224,403 7/1993 Rueb ..... 81/478 X

FOREIGN PATENT DOCUMENTS 2829009 7/1980 Germany ..... 81/479

*Primary Examiner*—James G. Smith
*Attorney, Agent, or Firm*—Harold E. Meier

[57] ABSTRACT

An adjustable torque ratchet wrench has a ratchet gear to be meshed with a ratchet pawl that restrains movement of the ratchet gear when a handle is rotated. The ratchet gear includes a shaft connected to a removeable fitting for engaging a bolt or the like to be tightened. The ratchet pawl is mounted on a moveable ratchet pawl block. The ratchet pawl block and the ratchet pawl are urged toward the ratchet gear by an adjustable spring assembly. The user selects a limiting torque using an adjustment means. When the limiting torque is achieved, the force of the spring is overcome and the ratchet pawl disengages from the ratchet gear as the ratchet pawl block slides in the direction of the spring. No further tightening of the bolt may then take place. Embodiments disclosed use varied spring types including disc springs, flat springs, coil springs, loop springs and a series of flat, overlapping springs.

An embodiment having a piezoelectric element for detecting the amount of torque and transmitting the value as an electrical signal to assist the operator in knowing how much torque has been applied. A display provides real time monitoring of the tightening process.

13 Claims, 4 Drawing Sheets

RATCHET HANDLE WITH TORQUE ADJUSTMENT

TECHNICAL FIELD

This invention relates to a ratchet handle for tightening bolts and the like, and more particularly to a ratchet handle that detects and controls the amount of applied torque.

BACKGROUND OF THE INVENTION

Threaded screws, bolts, nuts and the like are commonly used in industry to join elements of an apparatus to one another. The bolts are commonly tightened with tools such as spanners or wrenches that are old in the art. These spanners and wrenches generate a large angular moment as the bolt is being tightened in order to achieve a tight fit between the elements.

In some applications, however, the amount of force applied to the bolt must be strictly controlled. For example, when an engine cover is joined to an engine body using bolts, the torque on each of the bolts must be strictly controlled in order to distribute the pressure generated by the bolts equally over a gasket between the engine body and the engine cover. Using an ordinary spanner or wrench, equalizing the torque on each of the bolts depends upon the skill of the individual worker performing the tightening operation. This leads to inconsistent results and concomitant quality control problems resulting in a loss of sales and good will to the manufacturer.

One solution to the problem of uniformity in torque application to tighten bolts has been to use a tool known to the art as a torque wrench. The torque wrench typically has a ratchet gear mounted on a fitting which engages a bolt to be tightened. The ratchet gear is meshed with a pawl member urged against the ratchet gear by a spring. When the bolt is tightened, force is applied to the bolt until a level of torque equivalent to the spring force is attained. Upon exceeding the spring force, the ratchet gear and the pawl are disengaged, allowing the pawl to turn freely, preventing further torque from being applied to the bolt. Thus, an upper limit is set on the amount of torque applied to the bolt.

The major problem with a torque wrench of the above-described design is that the spring force is not easily determined when the tool is in use. While the torque limit can be adjusted to meet the needs of varied applications, the operator does not know how much torque has been applied or how much more is needed at any given time during the operation. Thus, there is a need in the industry for an adjustable tool wherein the amount of torque applied to a bolt can be varied with the application and wherein the tool displays the amount of torque being applied at any time during the tightening operation.

SUMMARY OF THE INVENTION

The present invention overcomes the limitations of the prior art tools described above by providing a tool with a spring means, wherein the spring force and the resulting limiting torque can be adjusted. The present invention incorporates a ratchet gear meshed with a ratchet pawl. Tightening or loosening of a bolt or the like may be accomplished by movement of a handle which transmits torque to the ratchet gear by means of a ratchet pawl. The ratchet gear, in turn, transmits the torque to a shaft having a socket which engages the bolt to be tightened. Movement of the handle thus results in the tightening of the bolt.

An adjustable spring assembly is set to reflect the desired limiting torque. The spring assembly urges a moveable pawl block having a ratchet pawl to mesh the ratchet pawl with the ratchet gear. When the desired limiting torque is reached, the pressure of the spring assembly is overcome and the pawl block and the ratchet pawl slide away from the ratchet gear, allowing the ratchet pawl to disengage from the ratchet gear. No further tightening of the bolt may then take place. An embodiment of the invention is also claimed which allows the tool to be used as a conventional ratchet wrench, without the adjustable torque limiting feature.

Various embodiments of the present invention include those using disc springs, opposing flat springs, opposing crooked flat springs, coil springs and loop-shaped flat springs. In another embodiment a series of flat, overlapping springs may be configured to allow the limiting torque pressure to be adjusted in small increments.

A piezoelectric element is provided to convert the rotational torque to an electrical signal so that the detected torque may be constantly displayed. Other advantages and applications derived from the use of the invention will readily suggest themselves to those skilled in the art from consideration of the following Detailed Description taken in conjunction with the accompanying Drawings.

BRIEF DESCRIPTION OF THE DRAWINGS

A more complete understanding of the invention may be obtained by reference to the following Detailed Description when taken in conjunction with the accompanying Drawings, wherein.

DETAILED DESCRIPTION OF THE DRAWINGS

Figure 1:
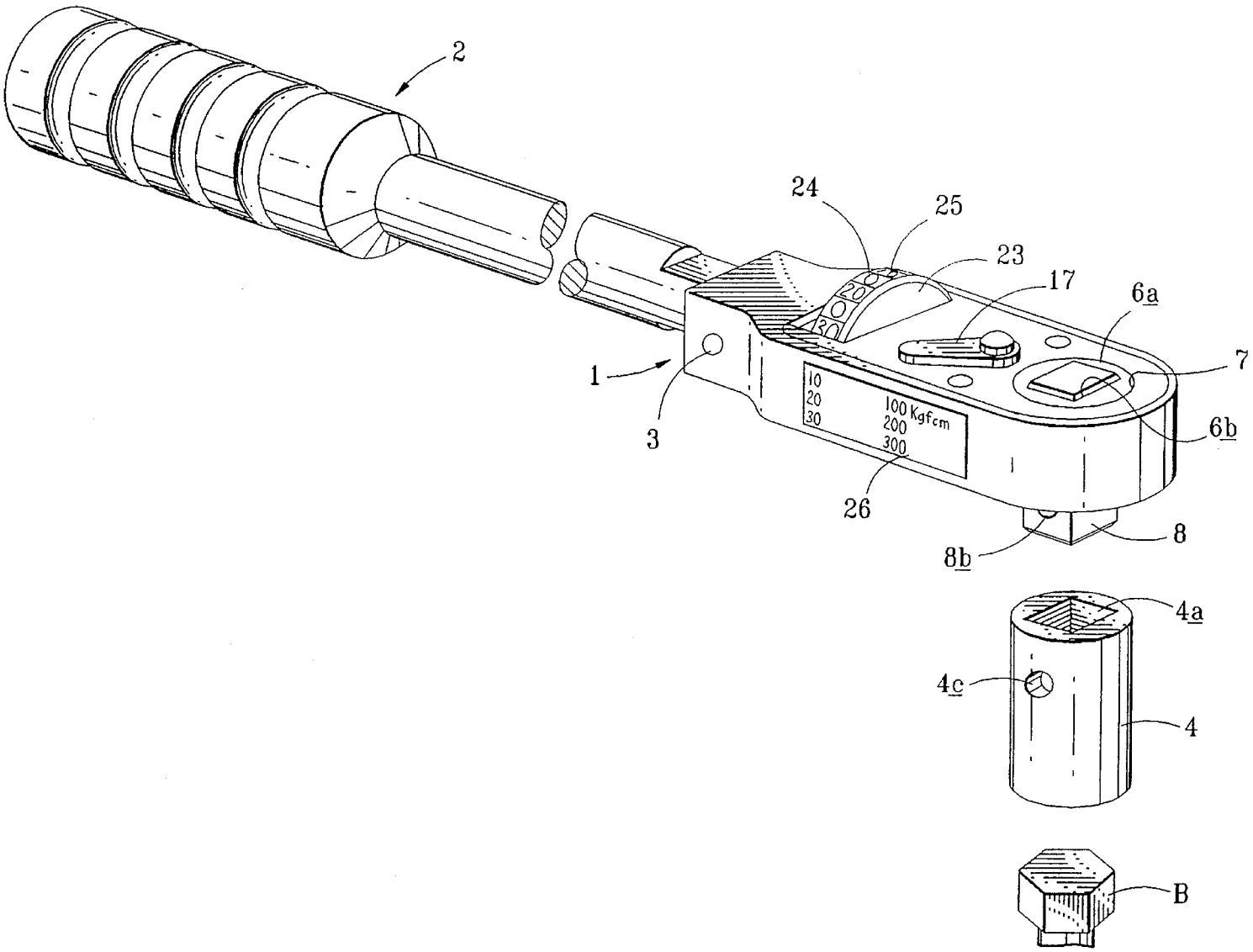
FIG. 1 shows a side view of the ratchet handle of the present invention.

Referring now to the drawings, and particularly to FIG. 1, there is shown a ratchet handle for tightening or loosening bolts, screws and the like wherein a body 1 is mounted to a handle 2 and held in place by a knock pin 3. A socket 4 fits over an object to be tightened or loosened by rotational movement, for example a bolt, screw, nut or the like, indicated by B.

It should be noted that the tool of the present invention may be used to tighten or loosen many types of threaded bodies including but not limited to screws, bolts, nuts and the like. The term "bolt" should be understood to include other threaded bodies. The term "tighten" is used for convenience and should be understood to include any rotational movement of the body.

Figure 2:
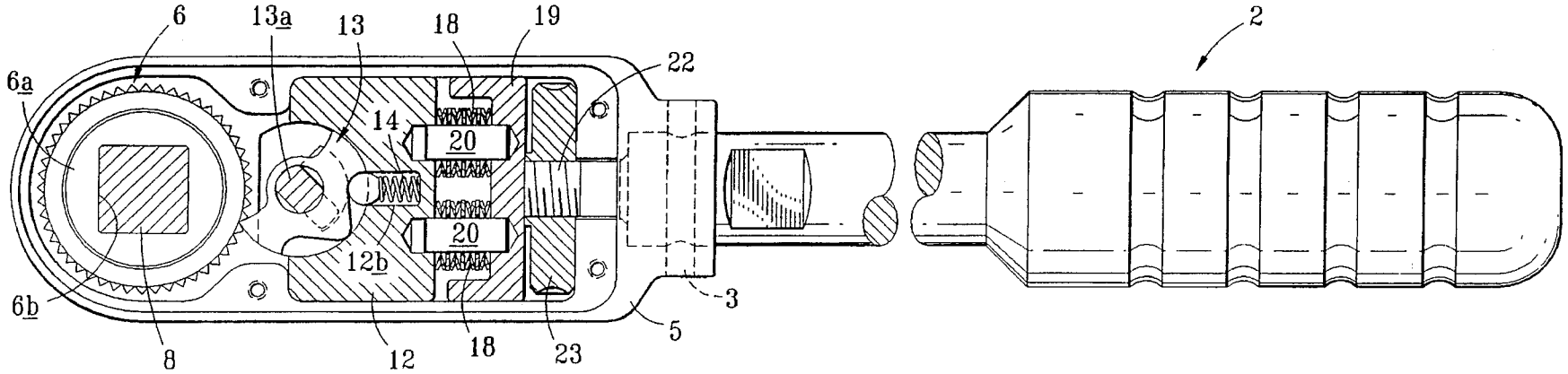
FIG. 2 shows the ratchet handle device as viewed from the underside.
Figure 3:
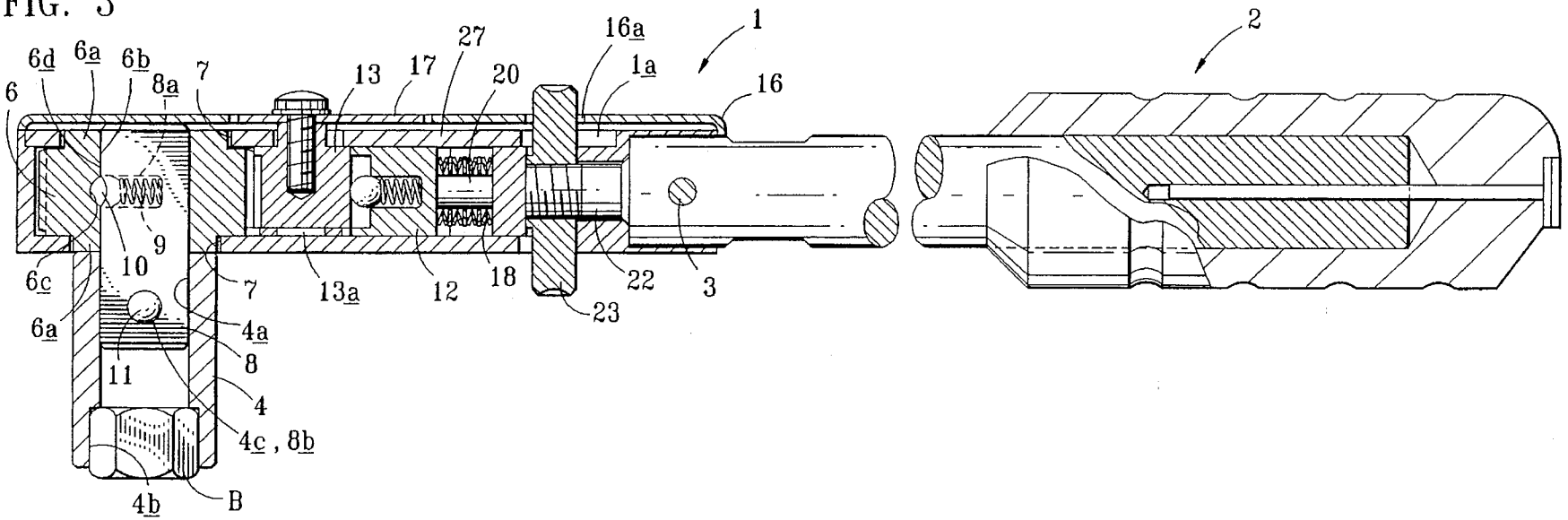
FIG. 3 is a lateral cross-sectional view of the ratchet handle device.

As best seen in FIG. 2 and FIG. 3, the body 1 includes a flat body case 5 containing a rotatably mounted ratchet gear 6. Shoulders 6*a* are formed on the top and bottom of the ratchet gear 6 which are mated with apertures 7 formed in the wall of the body case 5 to retain the ratchet gear on the body 1.

A bore 6*b* extending through the axial center of the ratchet gear 6 includes an indentation 6*c* in the bore wall 6*d*. The bore is preferably square in shape. A rotation shaft 8 to be retained in the bore 6*b* contains a passage 8*a* which is perpendicular in orientation to the length of the shaft. A spring 9 and ball 10 are loaded into the passage 8*a*. The ball 10 may be constructed of a material having a hard, smooth surface, preferably stainless steel. The shaft 8 is joined to the ratchet gear 6 by affixing the ball 10 to the indentation 6*c* in the bore wall 6*d* by methods well known in the art, for instance, by welding.

A socket 4 (shown in cross-section) is formed with an top opening 4*a* to engage the rotation shaft 8 and a bottom opening to engage the head of bolt B. The socket 4 is retained on the rotation shaft 8 by pin 11 which is inserted through aperture 4*c* in socket 4 and through corresponding aperture 8*b* in shaft 8.

Figure 4:
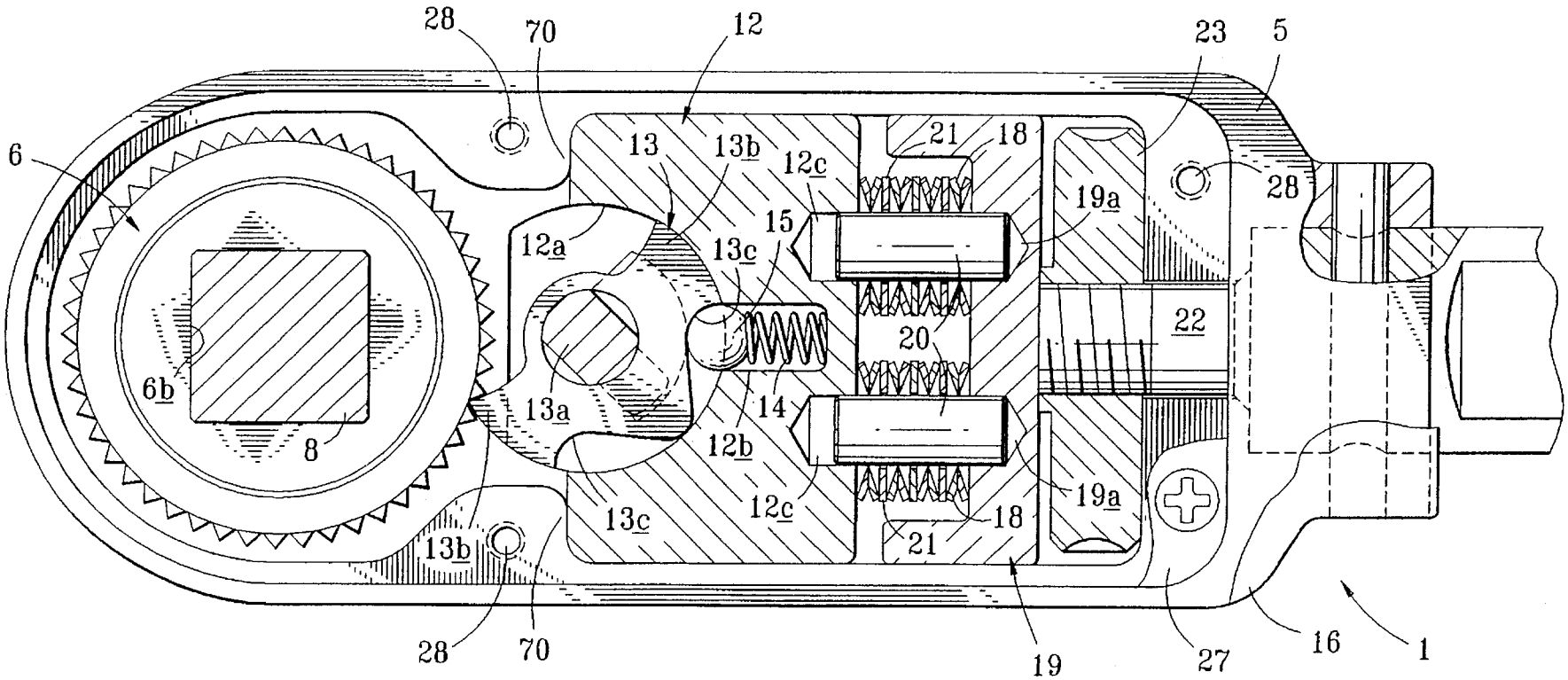
FIG. 4 is an enlarged view of the body of the ratchet handle device containing an adjustable spring mechanism, ratchet pawl and ratchet gear.

Referring now to FIG. 4, a pawl block 12 is slidably contained within the body 1 so that movement of the pawl block 12 is possible in the lengthwise direction of the body 1. A fitting indentation 12*a* is formed in one end of the pawl block 12 to receive a ratchet pawl 13. A bore 12*b* parallel to the length of the body 1 is formed in the pawl block 12 so that the bore 12*b* terminates in the center of the fitting indentation 12*a*. A ball member 15 urged by a spring member 14 is loaded into the bore 12*b* with the ball member 15 impinging into the fitting indentation 12*a*.

A rotational direction restriction indentation 13*c* in the ratchet pawl 13 receives a portion of the steel ball 15 and restrains movement of a pawl member 13*b*. A direction conversion lever 17 (see FIG. 3) extends from the top of ratchet pawl 13 atop externally mounted cover 16 of the body 1 to rotate the ratchet pawl from a position for a right hand screw motion to a position for a left hand screw motion. If torque is applied in the direction counter to that determined by direction conversion lever 17, the pawl member does not engage the ratchet gear 6 and no tightening takes place.

A torque adjustment spring 18 and spring bearing 19 exert force on the pawl block 12 as a bolt is being tightened. Apertures 19*a* and 12*c* penetrate the spring bearing 19 and the pawl block 12 respectively and are aligned to receive a slidable pin 20, linking the spring bearing to the pawl block and allowing movement of the pawl block along the pin.

Figure 5:
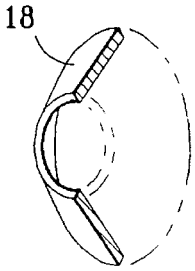
FIG. 5 shows the adjustable disc spring of the present invention.

The torque adjustment spring 18 comprises in one embodiment a series of conical disc springs, an example of which is shown in FIG. 5. The springs are interposed between multiple spacer plates 21 (see FIG. 4). The springs and spacer plates surround pin 20.

A screw shaft 22 abutting spring bearing 19 having an adjustment operating ring 23 allows adjustment of the torque limit. Manual operation of the adjustment operating ring adjusts the screw shaft 22 in a forward/backward direction, varying the position of the spring bearing 19, compressing or decompressing the springs 18.

The adjustment operating ring 23 on the screw shaft 22 partially protrudes from the openings 1*a* and 16*a* (FIG. 3) of the device body 1 and external cover 16. A rotation operating pin (not shown) may be inserted in one of the multiple fitting holes 24 (FIG. 1 ) formed in the adjustment operating ring 23 to facilitate rotation of the adjustment operating ring 23. A chart panel 26 on the side of the body 1 lists the torque values corresponding to the torque setting provided by the numerals 25 on the adjustment operating ring 23, allowing the operator to know the torque setting at any given position of the adjustment operating ring 23. A top cover plate 27 is attached to the body 1 by screw assembly 28 (FIG. 3).

Figure 6:
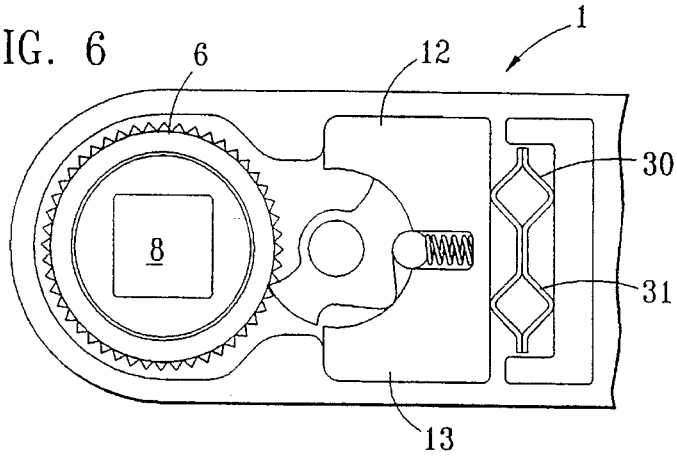
FIG. 6 is a drawing of an embodiment of the present invention using opposing flat springs with a center contact.
Figure 7A:
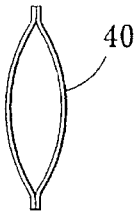
FIGS. 7A and 7B show spring configurations using opposing flat springs and a loop-shaped flat spring.

Other embodiments of the present invention are shown in FIGS. 6–9. FIG. 6 illustrates the use of a pair of opposing flat springs 30 and 31 which are substituted for the disc spring 18. The springs 30 and 31 are configured so as to contact one another at their mid-sections. Other embodiments include the use of opposing crooked flat springs 40 (FIG. 7A) and a loop-shaped flat spring 50 (FIG. 7B). The looped flat spring 50 may be constructed of a sheet of spring plate material configured into a loop-shape such that the ends contact one another.

Figure 8:
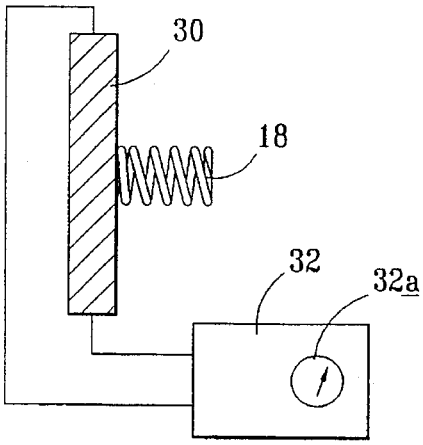
FIG. 8 shows a coil spring and a piezoelectric electric element.
Figure 7B:
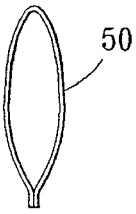

In another embodiment shown in FIG. 8 a piezoelectric element 30 is provided between the pawl block 12 and the adjustment spring 18. The rotational torque transmitted from the ratchet 6 is applied to the piezoelectric element 30 and is converted to an electrical signal by a circuit 32. The detected torque value obtained can be displayed in real time on a display means 32*a*.

Figure 9:
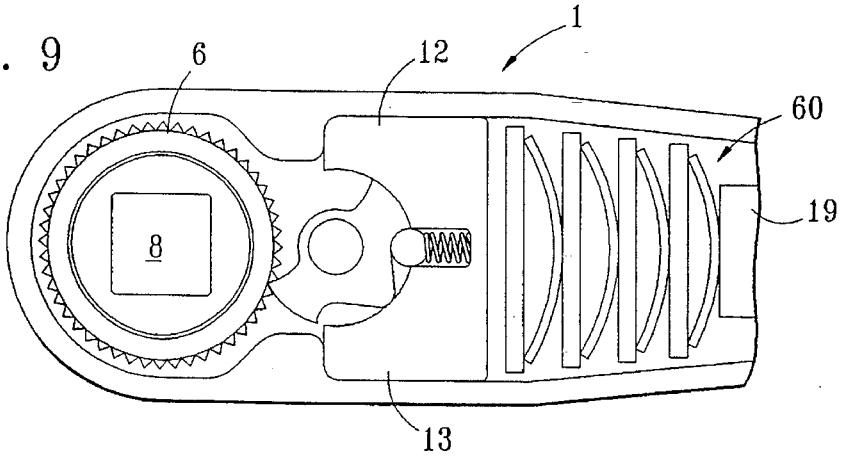
FIG. 9 is a configuration of the present invention having multiple, overlapping flat springs.

In another embodiment illustrated in FIG. 9 a torque adjustment spring 60 is constructed of multiple overlapping flat springs having different spring constants. The springs making up the torque adjustment spring 60 are arranged so that the spring constants are ordered from largest to smallest or alternately from smallest to the largest, giving a finer incremental adjustment when the adjustment operating ring 23 is manipulated.

An operating pin (not shown) is inserted into the fitting hole 24 and the adjustment operating ring 23 rotated until the desired maximum torque setting is attained as evidenced by numerals 25. The spring bearing 19 advances as the adjustment operating ring 23 is rotated on screw shaft 22, increasing the corresponding pressure of the torque adjustment spring 18, interposed between the spring bearing 19 and the pawl block 12.

The direction conversion lever 17 may be rotated to accommodate either a left or right hand screw. When the conversion lever 17 is rotated, the steel ball 15 fits into either the right hand or the left hand side of the rotation direction restriction indentation 13*c* of the ratchet pawl 13. As a result, the pawl member 13*b* which engages the ratchet gear 6 is correctly positioned for the desired direction of rotation. If the handle 2 is turned in the direction indicated by the position of the conversion lever 17, the ratchet gear 6 is linked to the pawl member 13*b* and the ratchet gear 6 may be advanced. If the handle 2 is turned in a direction counter to the setting of the conversion lever 17, the pawl member 13*b* disengages the ratchet gear 6.

The socket 4 is mounted onto the rotation shaft 8 using top opening 4*a* and the bolt to be tightened is engaged by the bottom opening 4*b*. A force is applied to the handle 2, which is transmitted to the ratchet pawl 13, the pawl block 12, the ratchet gear 6, to the socket 4 and ultimately to the bolt B. During the operation, the load of the pawl block 12 is borne by the torque adjustment spring 18.

When the torque reaches the set spring pressure determined by torque adjustment spring 18, the pawl block 12 recedes toward spring bearing 19, breaking the linkage between ratchet pawl 13 and ratchet gear 6. If the adjustment operating ring 23 is set to its highest setting, both spring bearing 19 and pawl block 12 are pressed against shoulder 70 (FIG. 4) on the body 1 and there is no torque adjustment function.

Although preferred embodiments of the invention have been illustrated in the accompanying Drawings and described in the foregoing Detailed Description, it will be understood that the invention is not limited to the embodiments disclosed, but is capable of numerous rearrangements and modifications of parts and elements without departing from the scope of the invention.

I claim:

1. A torque ratchet handle comprising:

a handle;

a body connected to the handle;

a ratchet gear rotatably mounted in the body;

a shaft affixed to the ratchet gear that rotates in response to the rotation of the handle and the ratchet gear;

a ratchet pawl adjacent the ratchet gear for meshing with the ratchet gear and restraining rotation of the ratchet gear as the handle is rotated;

ratchet pawl support means affixed to the ratchet pawl wherein the support means is moveable within the body in a direction perpendicular to the shaft;

spring means adjacent the support means for elastically urging the support means and the ratchet pawl to contact the ratchet gear in opposition to rotational torque received from the ratchet gear and the ratchet pawl; and adjustment means abutting the spring means for adjusting the elastic spring force of the spring means as applied to the support means.

2. The torque ratchet handle of claim 1 wherein the spring means comprises a spring bearing and a torque adjustment spring wherein the spring bearing is between the torque adjustment spring and the adjustment means.

3. The torque ratchet handle of claim 2 wherein the torque adjustment spring comprises a disc spring.

4. The torque ratchet handle of claim 2 wherein the torque adjustment spring comprises a pair of opposing flat springs.

5. The torque ratchet handle of claim 2 wherein the torque adjustment spring comprises a sheet of spring plate material bent into a loop shape.

6. The torque ratchet handle of claim 2 wherein the torque adjustment spring comprises a coil spring.

7. The torque ratchet handle of claim 2 wherein the torque adjustment spring comprises a series of flat springs having different spring constants wherein the springs overlap one another in a direction perpendicular to that of the shaft.

8. The torque ratchet handle of claim 1 wherein the adjustment means comprises a screw shaft and an adjustment operating ring to change force exerted by the screw shaft on the spring means.

9. The torque ratchet handle of claim 8 wherein the adjustment operating ring extends upwards of the body in a position for manual operation.

10. The torque ratchet handle of claim 9 wherein the adjustment operating ring further comprises multiple fitting holes for receiving a rotation operating pin to facilitate rotation of the adjustment operating ring.

11. The torque ratchet handle of claim 10 further comprising designations corresponding to the fitting holes to indicate the applied torque force.

12. The torque ratchet handle of claim 1 further comprising a piezoelectric element coupled to the spring means for detecting the rotational torque transferred from the ratchet gear and converting said torque into an electrical signal.

13. The torque ratchet handle of claim 12 further comprising a display means connected to the piezoelectric element for detecting and displaying said amount of rotational torque.

* * * * *